US007841895B2

(12) United States Patent
Zhu et al.

(10) Patent No.: US 7,841,895 B2
(45) Date of Patent: Nov. 30, 2010

(54) STACKED CARD EDGE CONNECTOR ASSEMBLY HAVING EJECTOR FOR REMOVING INSERTED CARDS SIMULTANEOUSLY

(75) Inventors: Jian-Kuang Zhu, Kunshan (CN); Xiao-Gao Yang, Kunshan (CN); Zhen-Hua Wang, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/770,689

(22) Filed: Apr. 29, 2010

(65) Prior Publication Data

US 2010/0279528 A1 Nov. 4, 2010

(51) Int. Cl.
*H01R 13/66* (2006.01)

(52) U.S. Cl. ..... 439/541.5; 439/325

(58) Field of Classification Search ..... 439/325, 439/326, 328, 541.5

See application file for complete search history.

(56) References Cited

U.S. PATENT DOCUMENTS 6,126,472 A 10/2000 Choy
6,648,680 B1 * 11/2003 Hu ..... 439/541.5
6,666,717 B1 * 12/2003 Choy ..... 439/541.5
7,101,222 B2 * 9/2006 Ho et al. ..... 439/541.5
7,207,810 B2 * 4/2007 Kuo et al. ..... 439/541.5
7,247,055 B2 * 7/2007 Watanabe ..... 439/630

* cited by examiner

*Primary Examiner*—Tho D Ta
(74) *Attorney, Agent, or Firm*—Andrew C. Cheng; Wei Te Chung; Ming Chieh Chang

(57) ABSTRACT

A card edge connector assembly includes a first connector comprising a first insulative housing defining a first central slot expanding along a transverse direction and a pair of first side arms disposed at opposite ends thereof. A plurality of first terminals are arranged at opposite sides of the first central slot. A second connector stacked with the first connector includes a second insulative housing defining a second central slot expanding along the transverse direction and a pair of second side arms disposed at opposite ends thereof. A plurality of second terminals are arranged at opposite sides of the second central slot. An ejecting device has a first and a second ejecting portions thereon for respectively projecting into the first and second central slots, therefore the ejecting device can release two cards at one time.

12 Claims, 12 Drawing Sheets

STACKED CARD EDGE CONNECTOR ASSEMBLY HAVING EJECTOR FOR REMOVING INSERTED CARDS SIMULTANEOUSLY

BACKGROUND OF THE INVENTION

1. Field of the Invention

The present invention relates to a card edge connector assembly, and more particularly to a stacked card edge connector assembly with a card ejecting device for ejecting both of the inserted cards at one time.

2. Description of the Related Art

U.S. Pat. No. 6,126,472 issued to Choy on Oct. 3, 2000 discloses a connector assembly including a lower housing and an upper housing each generally including the basic structure of the typical SO DIMM connector housing. Each housing defines two rows of passageways on two sides of the central slot in which the corresponding module is received. A plurality of contacts are received within the corresponding passageways wherein the tail of each contact extends downward to engage the corresponding circuit on the PC board on which the connector assembly is mounted. In this type of connector, the cards are slantwisely inserted into the central slots and then rotated to a horizontal level along an up-to-lower direction, which will take up a large space during the assembling process.

There is also another type of a connector assembly for saving the assembling space, in which both cards are inserted into the central slots in a horizontal manner, while if the cards need to be drawn out of the central slot, a large pulling force is needed, which is not easy for the operator. Obviously, an improved card edge connector assembly is highly desired to overcome the aforementioned problem.

SUMMARY OF THE INVENTION

Accordingly, an object of the present invention is to provide a card edge connector assembly convenient for an operator to release the cards mounted therein.

In order to achieve the object set forth, a card edge connector assembly comprises a first connector, comprising a first insulative housing defining a first central slot expanding along a transverse direction and a pair of first side arms disposed at opposite ends thereof. A plurality of first terminals are arranged at opposite sides of the first central slot. A second connector stacked with the first connector comprises a second insulative housing defining a second central slot expanding along the transverse direction and a pair of second side arms disposed at opposite ends thereof. A plurality of second terminals are arranged at opposite sides of the second central slot. An ejecting device has a first and a second ejecting portions thereon for respectively projecting into the first and second central slots.

Other objects, advantages and novel features of the invention will become more apparent from the following detailed description of the present embodiment when taken in conjunction with the accompanying drawings.

DETAILED DESCRIPTION OF THE INVENTION

Figure 1:
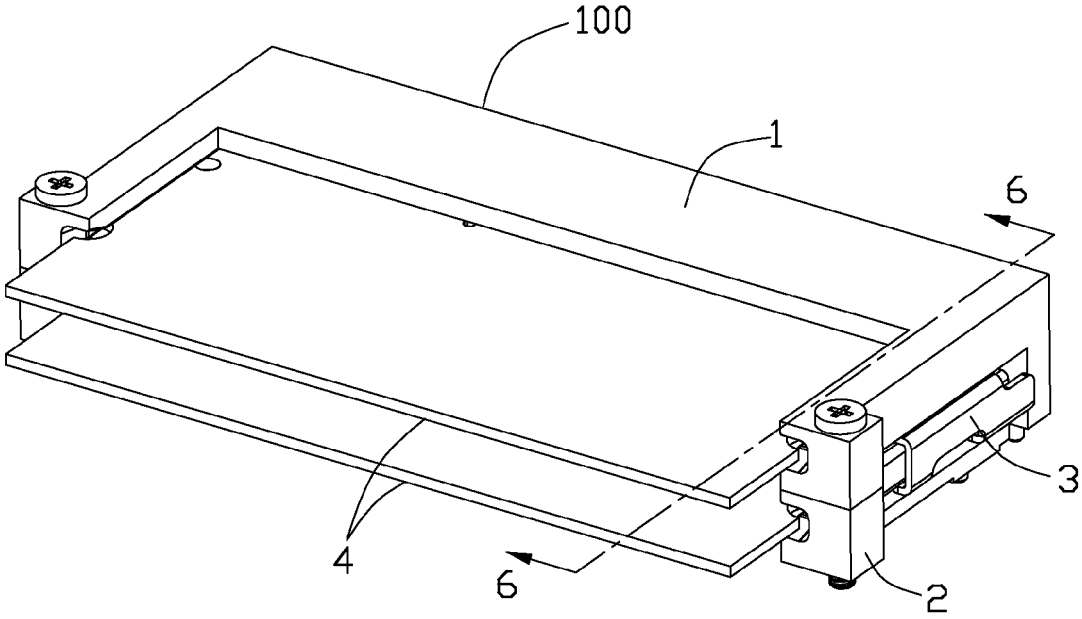
FIG. 1 is a perspective view of a card edge connector assembly in accordance with the present invention, in which a pair of cards are mounted therein.
Figure 2:
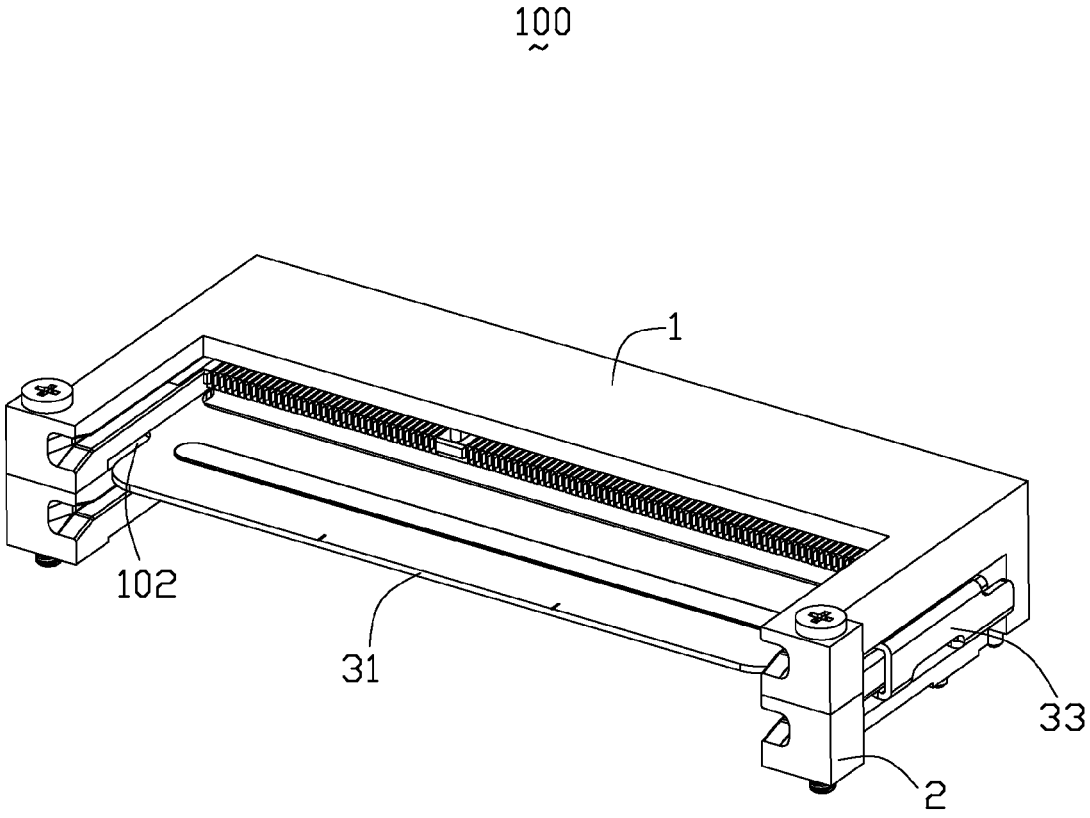
FIG. 2 is a perspective view of the card edge connector assembly shown in FIG. 1.

Reference will now be made to the drawing figures to describe a preferred embodiment of the present invention in detail. Referring to FIGS. 1 and 2, a card edge connector assembly 100 according to the preferred embodiment of the present invention is provided and comprises an upper connector 1 and a lower connector 2 for respectively connecting a pair of cards 4 to a printed circuit board (not shown) and an ejecting device 3 positioned between the upper and lower connectors 1, 2.

Figure 3:
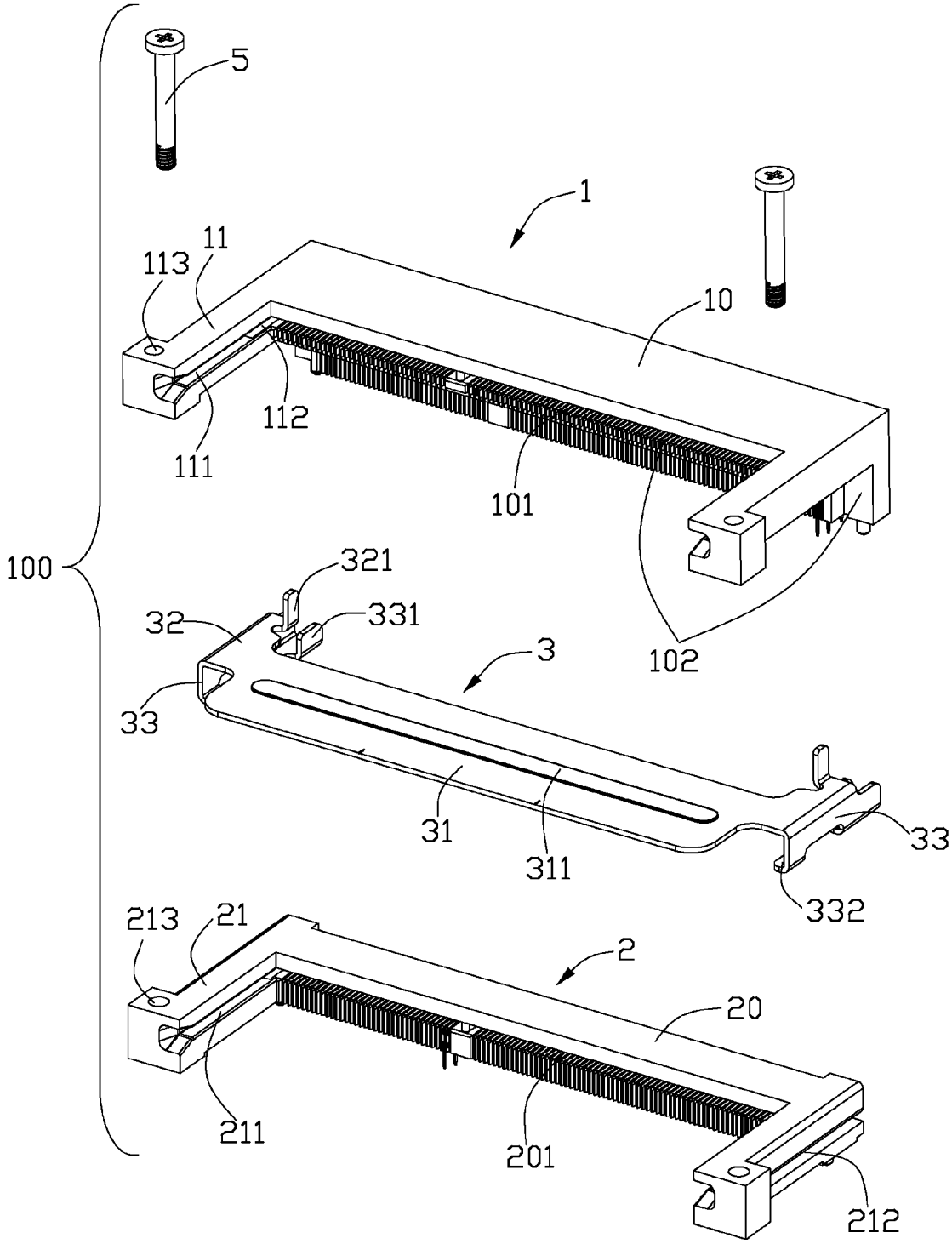
FIG. 3 is an exploded perspective view of the card edge connector assembly shown in FIG. 2.
Figure 4:
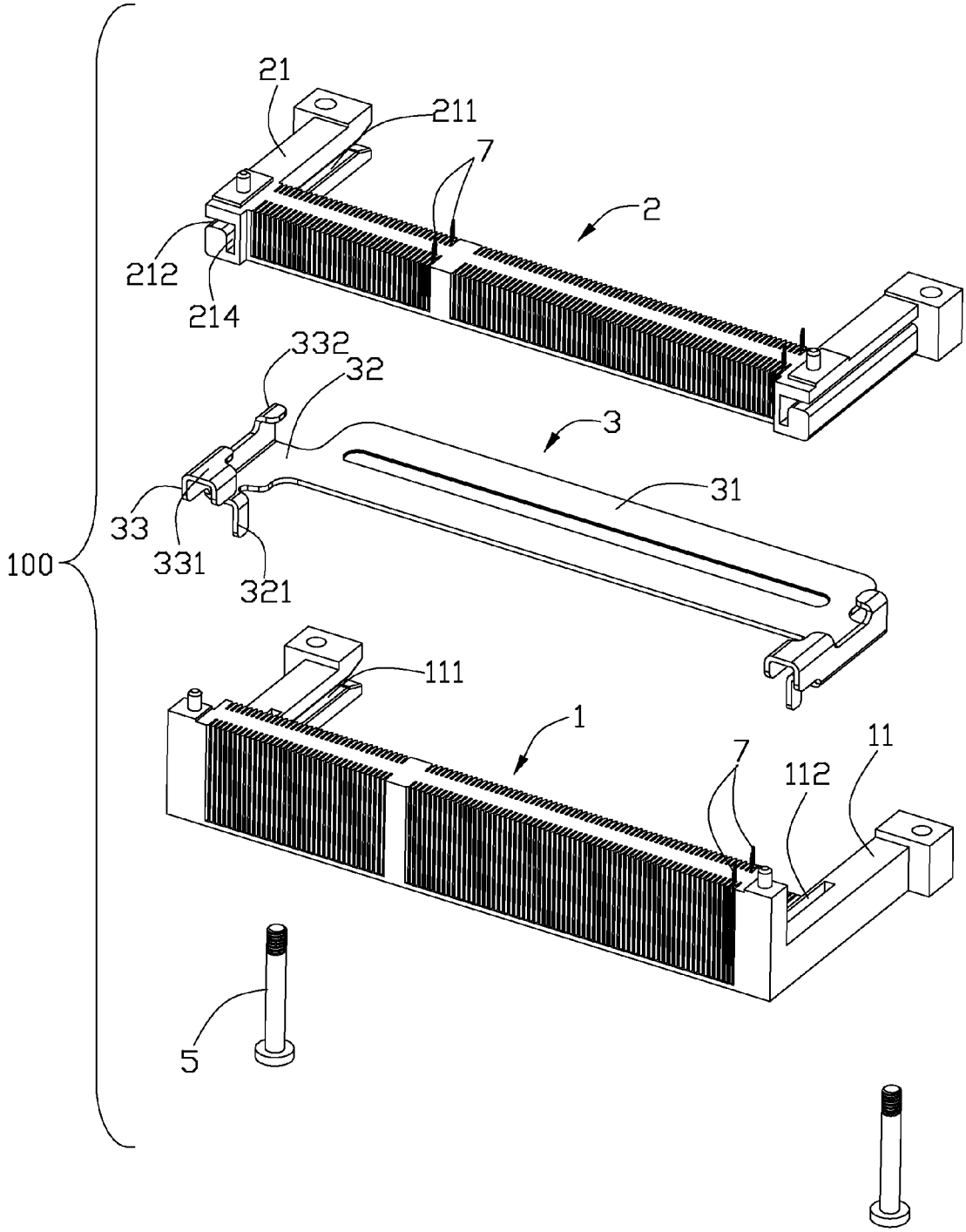
FIG. 4 is another perspective view of the card edge connector assembly shown in FIG. 2.

Referring to FIGS. 3 and 4, the upper connector 1 includes an elongated insulative housing 10 defining a central slot 101 expanding along a transverse direction for receiving the card 3 therein and a pair of side arms disposed at opposite ends thereof. A plurality of first terminals 7 are arranged at opposite sides of the central slot 101 for mechanically and electrically contacting with the card 3. Each side arm 11 defines a guiding slot 111 at an inner surface thereof and extending horizontally toward the central slot 101. In addition, each side arm 11 also defines a screw 113 thereon and running through the side arm 11 along a vertical direction. The guiding slot 111 and the central slot 101 are located at a same plane thereof and in communication with each other, therefore the card 3 can be inserted into the central slot 101 in a horizontal manner through the guiding slot 111. The insulative housing 10 defines a recess 102 extending backward from a front face thereof for receiving the lower connector 2 therein. The recess 102 communicates with the central slot 101 through a pair of apertures 112, each of which is defined at a distal end of the guiding slot 111.

The structure of the lower connector 2 is nearly same as the upper connector 1, comprises an elongated housing 20 with a pair of side arms 21 arranged at opposite ends thereof. The elongated housing 20 defines a central slot 201 expanding along a transverse direction and arranged a plurality of terminals 7 at opposite sides thereof. Each side arm 21 defines a guiding slot 211 at an inner face thereof and in communication with the central slot 201, and a passageway 212 at an outer face thereof and extending along a rear-to-front direction. The passageway 212 runs through the side arm 21 and communicates with the central slot 201 at a distal end thereof. An opening slot 214 is defined at a rear end of each side arm 21 and communicates with the passageway 212 and central slot 201 for allowing the ejecting device 3 to be inserted. At the opposite end of each side arm 21, a screw 213 is defined thereon and running through the side arm 21 along the vertical direction.

The ejecting device 3 is made by stamping a metallic shell and comprises a rectangular operation portion 31 and a pair of connecting portions 32 extending horizontally from opposite ends thereof. A first ejecting portion 321 extends upward from an inner edge of the connecting portion 32 and is spaced away from the operation portion 31. A bending portion 33 extends downward from outer lateral edge of the connecting portion 32, on a lateral edge of which a second ejecting portion 331 is formed under the first ejecting portion 321. The first and second ejecting portions 331, 321 are arranged along a front-to-rear direction and commonly positioned in a same plane. The bending portion 33 also forms a blocking portion 332 extending perpendicularly from a bottom edge of the bending portion 33 and spaced from the second ejecting portion 331. An elongated slot 311 is defined on the operation portion 31 for inserting a tie or other drawer device for pulling the operation portion 31.

Figure 5:
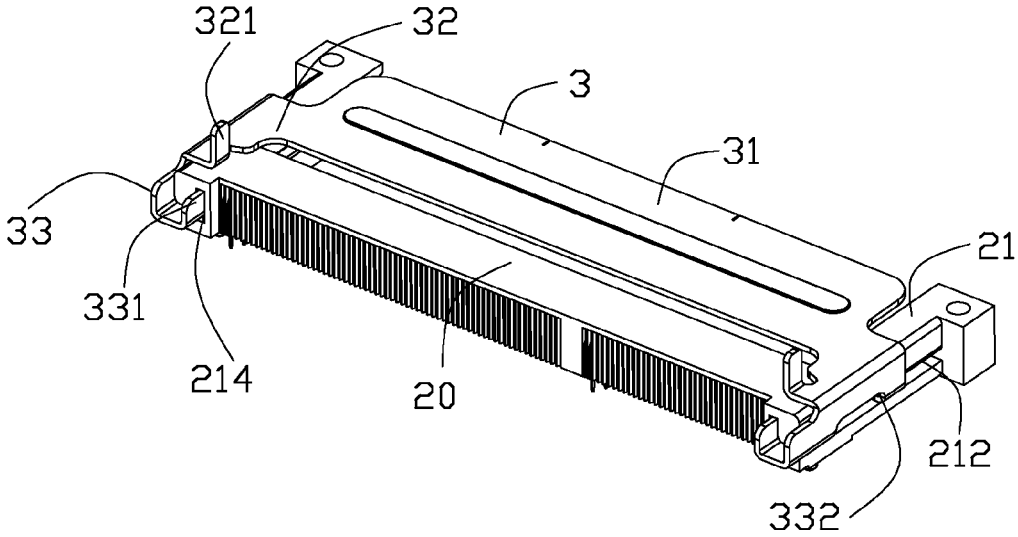
FIG. 5 is perspective view of a lower connector shown in FIG. 2 with an ejecting device mounted thereon.

Referring to FIG. 5, the ejecting device 3 is assembled on the lower connector 2 with each blocking portion 332 being inserted into the corresponding passageway 212. With the forward movement of the blocking portion 332, the second ejecting portion 331 slides into the opening slot 214 and the bending portion 33 attaches to the side arm 21. Further, the second ejecting portion 331 projects into the central slot 201 for abutting against a front edge of the card 4.

Then, the upper connector 1 is put onto the lower connector 2 as shown in FIG. 2. The lower connector 2 is substanicially received in the recess 102 and the operation portion 31 is positioned in front of the insulative housings 10, 20, meanwhile the connecting portions 32 are sandwiched between the side arms 11, 21 and the first ejecting portions 321 project into the central slot 101 through the apertures 112. A pair of posts 5 are inserted into the screws 113, 213 to combine the upper and lower connectors 1, 2 together. Under this condition, the ejecting device 3 could not release from the lower connector 2 anyhow.

Figure 6:
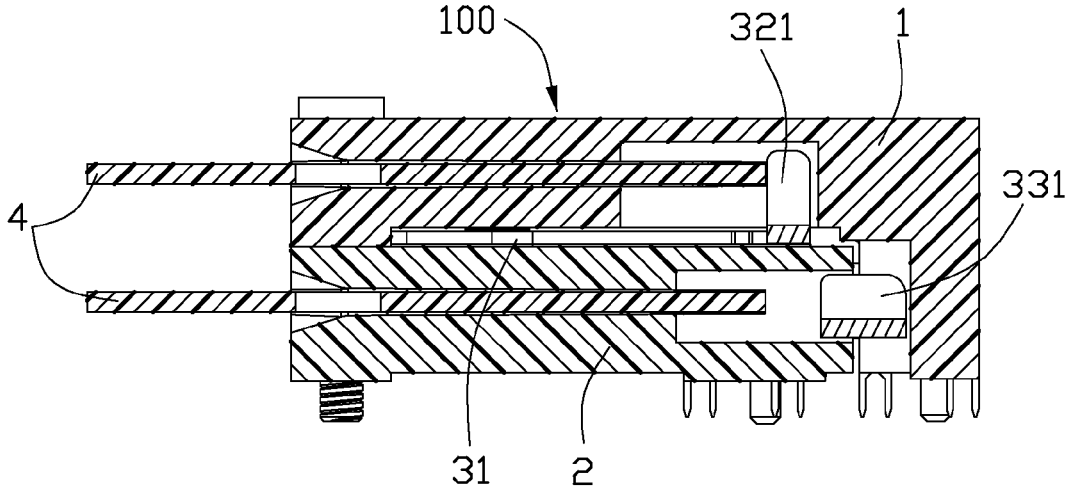
FIG. 6 is a cross-sectional view of the card edge connector assembly with the pair of cards mounted therein shown in FIG. 1 along line 6-6.

Referring to FIG. 6, after the electrical connector assembly is stacked together, the first and second ejecting portions 321, 331 are respectively exposed in the central slots 101, 201 and facing toward the front ends of the cards 4. When the cards 4 need to be drawn out of the central slots 101, 201, the operator could pull the operation portion 31 in a horizontal manner, as the first ejecting portion 321 is nearer to the front face of the insulative housing 10 than the second ejecting portion 331, the two cards 4 can be released from the central slots 101, 201 in turn at one time, which is easy and convenient for the operator.

FIGS. 7-12 show a second embodiment of the card edge connector assembly. For simply description, the same elements of the second embodiment of the card edge connector assembly indicate a same numeral as the first embodiment of the card edge connector assembly.

Figure 7:
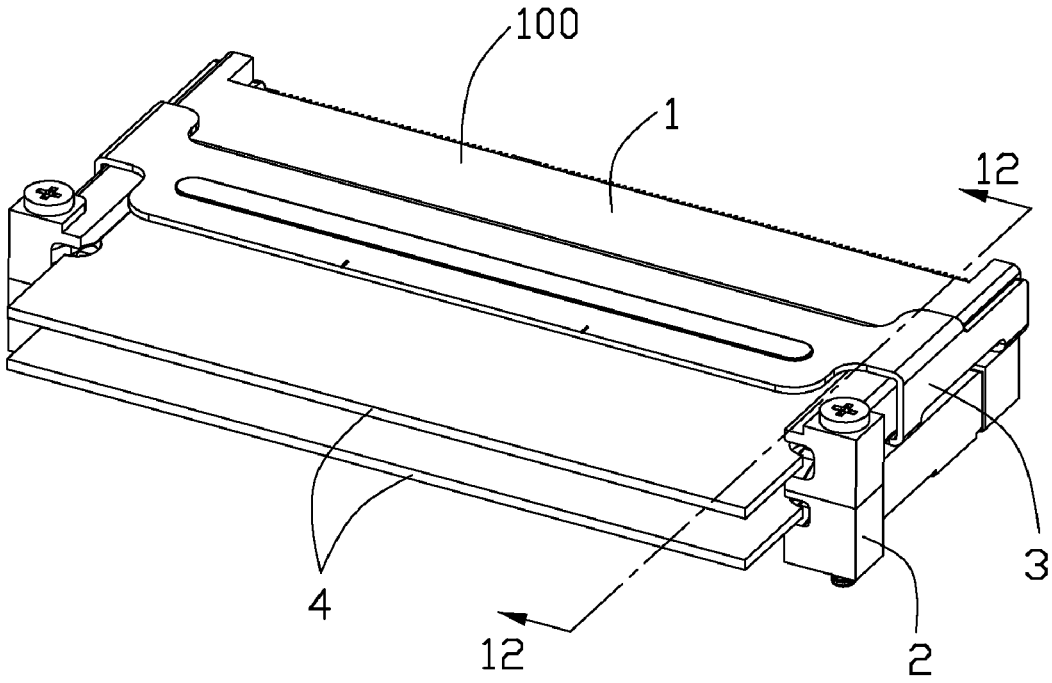
FIG. 7 is a perspective view of a second embodiment of the card edge connector assembly with a pair of cards mounted therein.
Figure 8:
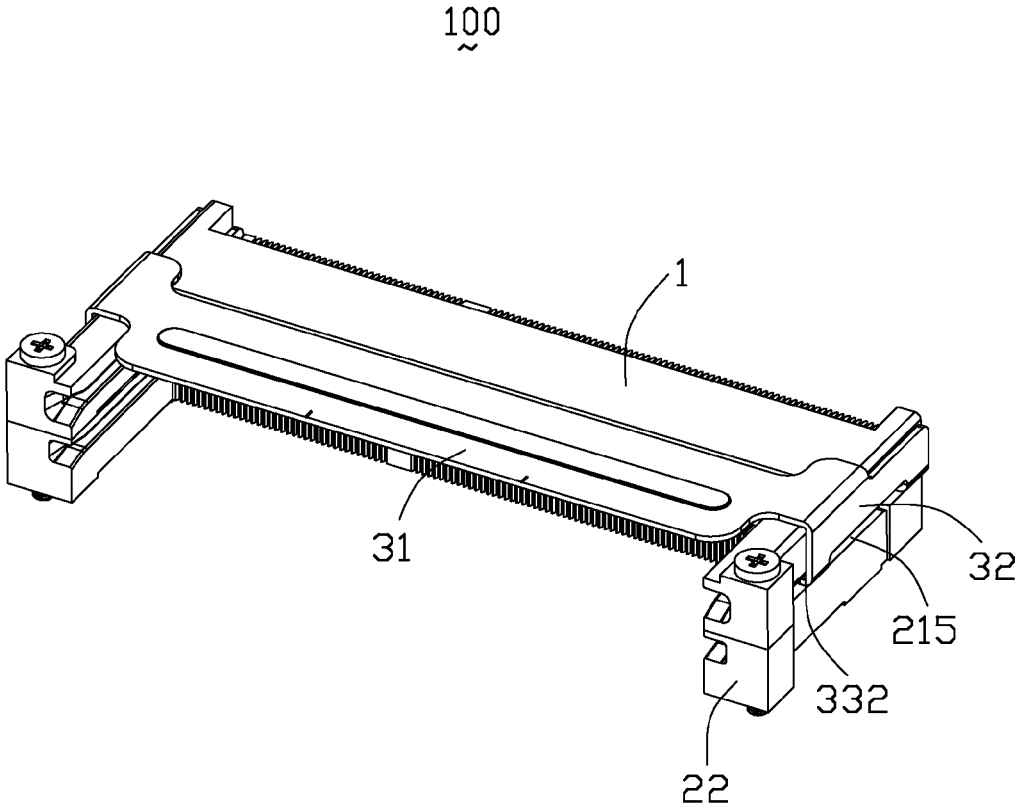
FIG. 8 is a perspective view of the card edge connector assembly shown in FIG. 7.
Figure 9:
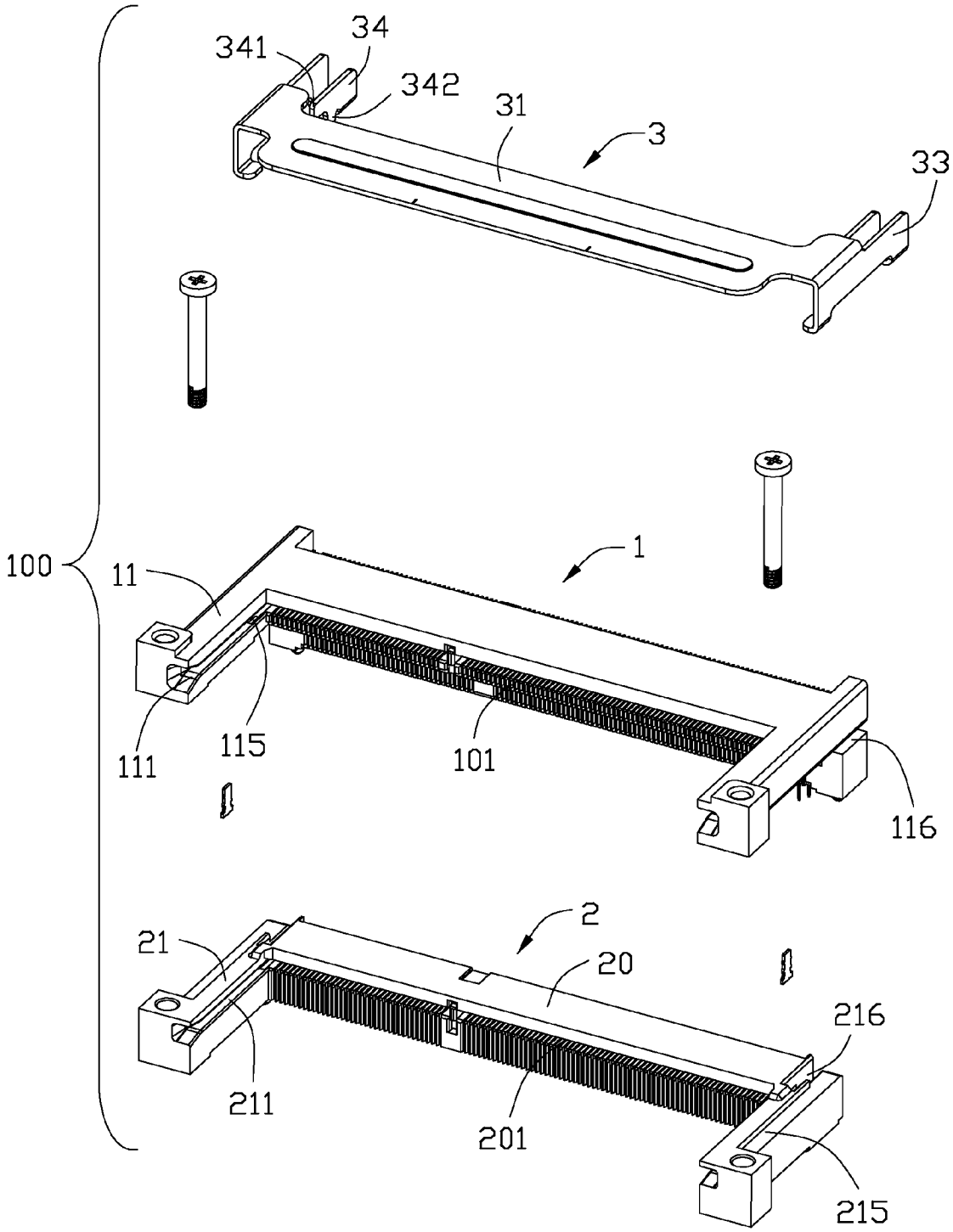
FIG. 9 is an exploded perspective view of the card edge connector assembly shown in FIG. 8.
Figure 10:
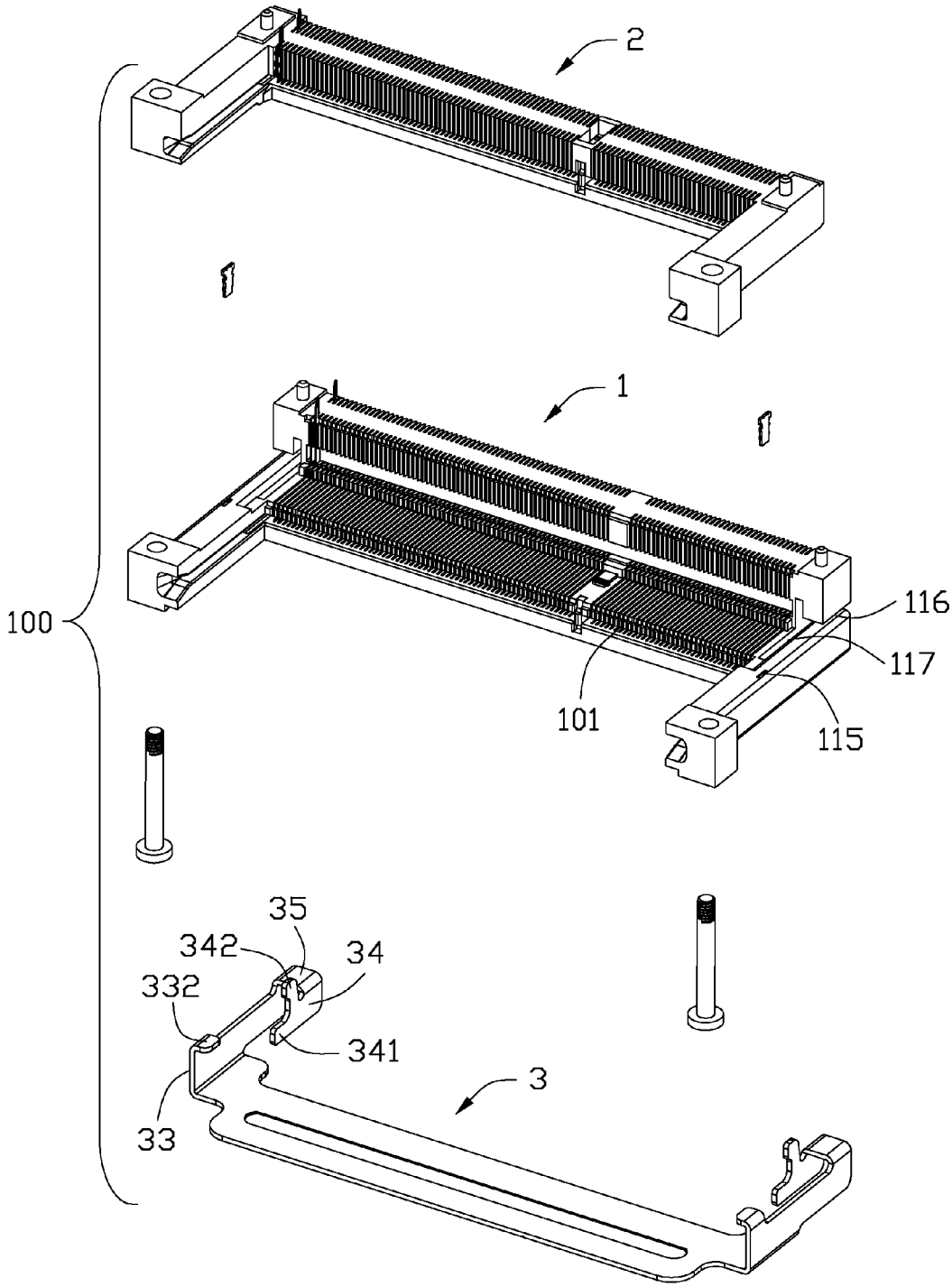
FIG. 10 is another exploded perspective view of the card edge connector assembly shown in FIG. 8.

Referring to FIGS. 7 and 8, the ejecting device 3 is assembled onto the upper connector 1. Referring to FIGS. 9 and 10, a pair of grooves 116 respectively extend forward from a rear end of the insulative housing 10 for allowing the ejecting device 3 to be inserted thereinto. A channel 117 which is in alignment with the groove 116 is defined at a bottom of each side arm 11 and extends forwardly with an aperture 115 defined at a lateral edge thereof. Each side arm 21 of the lower connector 2 defines a groove 216 extends forward from a rear end thereof and communicates with the central slot 201. Each side arm 21 of the lower connector 2 also forms a supporting portion 215 on a top face thereof.

The blocking portion 332 of the ejecting device 3 is defined on one end of each bending portion 33 and adjacent to the operation portion 31. An extending portion 35 extends horizontally from a lateral edge of the other end of the bending portion 33. The extending portion 35 is bent upwardly and forms an ejecting plate 34 parallel to the bending portion 33, therefore, the ejecting plate 34 and the extending portion 35 are located at a same side of the operation portion 31. A first and a second ejecting portions 341, 342 which are configured in a same plane and in a vertical relationship respectively extend from adjacent sides of the ejecting plate 34. The first ejecting portion 341 extends toward the operation portion 31 while the second ejecting portion 342 extends out of the extending portion 35.

Figure 11:
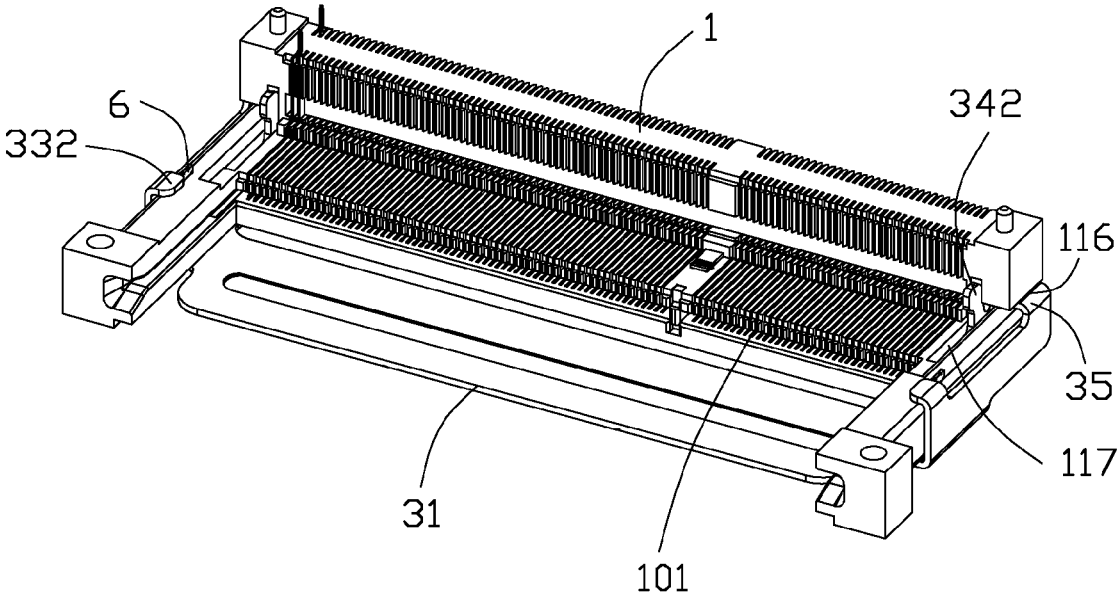
FIG. 11 is a perspective view of an upper connector shown in FIG. 8 with an ejecting device mounted thereon.

Referring to FIG. 11, the ejecting device 3 is assembled onto the insulative housing 10 along the rear-to-front direction with the blocking portion 332 entering into the groove 116. With the forward movement of the ejecting device 3, the ejecting plate 34 projects into the channel 117 and the first ejecting portion 341 projects into the central slot 101. When the blocking portion 332 slides over the aperture 115, a retaining pin 6 is provided and inserted into the aperture 115 for preventing the ejecting device 3 from releasing from the upper connector 1.

Referring to FIG. 8, after the lower connector 2 is assembled onto the upper connector, the operation portion 31 is located in front of the insulative housing 10 and the blocking portion 332 stands on the supporting portion 215 of the lower connector 2. As each channel 117 of the upper connector 1 is in alignment with each groove 216 of the lower connector 2 in the vertical direction, the second ejecting portion 342 projects into the groove 216 and faces toward the front end of the card 4 which is assembled into the central slot 201 of the lower connector 2.

Figure 12:
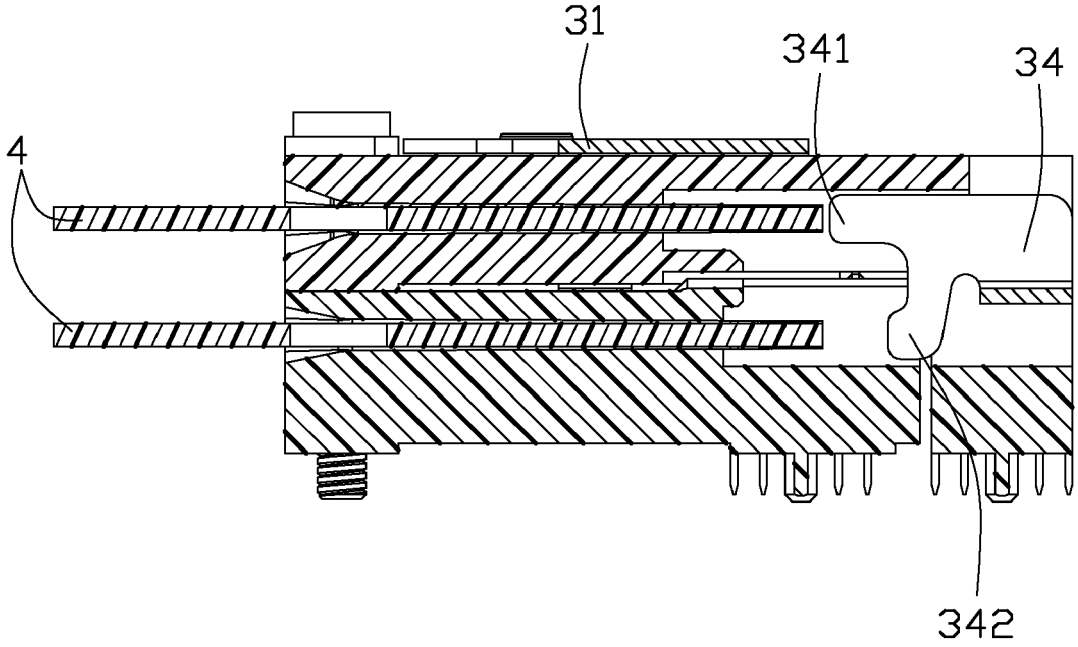
FIG. 12 is a cross-sectional view of the card edge connector assembly with the pair of cards mounted therein shown in FIG. 7 along line 12-12.

Referring to FIG. 12, the first ejecting portion 341 and the second ejecting portion 342 are respectively disposed in the central slots 101, 201 of the upper and lower connector 1, 2 and face toward the front end of the pair of cards 4. If the operation portion 31 is pulled outwardly, the first and second ejecting portion 341, 342 will abut against the front end of the cards 4 sequentially and release the cards at one time.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A card edge connector assembly for connecting a pair of electrical cards to a printed circuit board comprising:

a first connector, comprising a first insulative housing defining a first central slot expanding along a transverse direction and a pair of first side arms disposed at opposite ends thereof, a plurality of first terminals being arranged at opposite sides of the first central slot;

a second connector stacked with the first connector, comprising a second insulative housing defining a second central slot expanding along the transverse direction and a pair of second side arms disposed at opposite ends thereof, a plurality of second terminals being arranged at opposite sides of the second central slot;

an ejecting device having a first and a second ejecting portions thereon for respectively projecting into the first and second central slots;

wherein the first connector stands on the second connector, and the first ejecting portion is closer to the corresponding central slot than the second ejecting portion;

wherein the ejecting device comprises an operation portion located in front of the first insulative housing;

wherein the operation portion is located between the first and second side arms, and the first and second ejecting portions are located at opposite sides of the operation portion in a vertical direction perpendicular to the operation portion;

wherein the operation portion forms a pair of connecting portions at longitudinal ends thereof, the first ejecting portion perpendicular extends upward from an inner edge of each connecting portion, a bending portion perpendicular extends downward from an outer edge of each connecting portion, on which the second ejecting portion extends outwardly and upwardly to be coplanar with the first ejecting portion in the vertical direction.

2. The card edge connector assembly as described in claim 1, wherein each bending portion is tightly attached to the second side arm, on which a slot extends forwardly and communicates with the second central slot for receiving the second ejecting portion, and each first side arm defines a channel running therethrough and communicates with the first central slot for receiving the first ejecting portion.

3. The card edge connector assembly as described in claim 1, wherein the ejecting device is attached to the first connector, and the first and second ejecting portions are configured in a same plane and located at a same side of the operation portion.

4. The card edge connector assembly as described in claim 3, wherein a pair of bending portions extend downward from longitudinal ends of the operation portion and respectively attached to the first side arms, the first and second ejecting portions are spaced from the corresponding bending portion.

5. The card edge connector assembly as described in claim 4, wherein each bending portion defines a blocking portion at a lateral edge thereof and located in front of a retaining member secured on a bottom of the first side arm.

6. A card edge connector assembly comprising:

a first connector, comprising a first insulative housing defining a first central slot expanding along a transverse direction and a recess defined under the first insulative housing, a plurality of first terminals being arranged at opposite sides of the first central slot;

a second lower connector, comprising a second insulative housing received in said recess, the second insulative housing defining a second central slot expanding along the transverse direction and a pair of passageways extending along a rear-to-front direction and in communication with the second central slot, a plurality of second terminals being arranged at opposite sides of the second central slot;

an ejecting device comprising a first ejecting portion and a second ejecting portion; wherein the first ejecting portion is firstly projecting into the first central slot and then the second ejecting portion is projecting into the second central slot through the corresponding passageway;

wherein the first and second ejecting portions are located around a same plane and the first ejecting portion is located in front of the second ejecting portion.

7. The card edge connector assembly as described in claim 6, wherein the ejecting device comprises an operation portion, the first and second ejecting devices are located at a same side of the operation portion in a vertical direction which is perpendicular to the operation portion.

8. The card edge connector assembly as described in claim 6, wherein the ejecting device comprises an operation portion, the first and second ejecting devices are located at opposite sides of the operation portion in the vertical direction which is perpendicular to the operation portion.

9. The card edge connector assembly as described in claim 8, wherein the first and second ejecting portions are perpendicular to each other.

10. A card edge connector assembly comprising:

a lower connector including a lower insulative housing defining a lower horizontal slot for receiving a lower card;

a plurality of lower contacts disposed in the lower housing for engagement with the lower card;

an upper connector including an upper insulative housing defining an upper horizontal slot for receiving an upper card;

a plurality of upper contacts disposed in the upper insulative housing for engagement with the upper card;

an ejecting device sandwiched between the upper housing and the lower housing, and further back and forth moveable relative to the upper and lower housings in a front-to-back direction;

wherein one of said upper and lower housings defines a groove structure to allow the ejecting device to be assembled to said one of said upper housing and said lower housing;

said ejecting device including one ejecting portion extending into one of said upper horizontal slot and said lower horizontal slot for ejecting the corresponding card therein;

wherein said ejecting device further defines an other ejecting portion extending into the other of said upper horizontal slot and said lower horizontal slot;

wherein said ejecting portion and said another ejection portion are offset from each other in said front-to-back direction for ejecting the corresponding cards at different time;

wherein the other of said upper housing and said lower housing includes a wall to prevent withdrawal of the ejecting device from said one of the upper housing and the lower housing.

11. The card edge connector assembly as claimed in claim 10, wherein said one of the upper horizontal slot and said lower horizontal slot is defined by said one of the upper and lower housings.

12. The card edge connector assembly as claimed in claim 10, wherein said ejecting device is assembled to said groove along a direction parallel to said front-to-back direction.

* * * * *